United States Patent [19]

Kluppel et al.

[11] 4,168,742

[45] Sep. 25, 1979

[54] TUBE BUNDLE

[75] Inventors: George E. Kluppel; Ennis C. Smith, both of Houston, Tex.

[73] Assignee: Hudson Products Corporation, Houston, Tex.

[21] Appl. No.: 890,412

[22] Filed: Mar. 27, 1978

[51] Int. Cl.[2] ..... F28B 9/10

[52] U.S. Cl. ..... 165/114; 165/174

[58] Field of Search ..... 165/110, 110 D, 111, 165/114; 122/483

[56] References Cited

U.S. PATENT DOCUMENTS

| | | | |
|---|---|---|---|
| 2,205,292 | 6/1940 | Howard | 165/114 |
| 2,217,410 | 10/1940 | Howard | 165/111 |
| 3,275,070 | 9/1966 | Beatenbough et al. | 165/111 |
| 3,612,172 | 10/1971 | Dohnt | 165/174 |

FOREIGN PATENT DOCUMENTS

| | | | |
|---|---|---|---|
| 900407 | 7/1962 | United Kingdom | 165/114 |

*Primary Examiner*—Sheldon Jay Richter

[57] ABSTRACT

There is disclosed apparatus for condensing steam, or other vapors containing non-condensibles such as air, which includes bundles each made up of a single row of parallel, side-by-side and spaced-apart tubes over which air is passed in a direction transverse to the row. Each tube has substantially parallel side walls which are generally parallel to the side walls of adjacent tubes, with the side walls being substantially longer in the direction of air flow than the width of the tube.

4 Claims, 7 Drawing Figures

TUBE BUNDLE

This invention relates to air-cooled apparatus for condensing steam or other vapors containing non-condensibles such as air. More particularly, it relates to improved tube bundles for use as part of such condensing apparatus.

In apparatus of this type, the vapor, which may be steam from a turbine exhaust, is circulated through tubes which are arranged in parallel, side-by-side and spacedapart relation, and cooling air is caused to pass over the tubes in a direction generally transverse to the row. In a single pass arrangement, the steam is introduced into one end of the tubes of each bundle through an inlet header, and condensate is collected in and removed from an outlet header at the other end of the tubes, with the bundles disposed in a vertical or inclined position with the inlet header higher than the outlet header so as to cause condensate to drain into the outlet header. The non-condensibles are vented from the outlet header to suitable equipment for removing them to the atmosphere.

A conventional bundle of this type includes a plurality of such rows of tubes arranged in the direction of air flow with each row being connected to a common inlet header. As cooling air is passed over the rows of tubes of the bundles, it is heated so that the difference between its temperature and that of the vapor within the tubes of each row, and thus its cooling capacity, decreases in the direction of air flow. Consequently, although the vapor is introduced into the tube rows through a common inlet header, it enters the outlet header at different pressure levels. Thus, the lowest level is that which enters from the first row to be contacted by the air flow, and the highest level is that which enters from the last row to be so contacted.

With the outlet header common to all rows, uncondensed vapors are drawn into the first row to be contacted by air from one or more of the succeeding rows, and, to a lesser extent, into each successive row from one or more of those succeeding it. When such backflow occurs, pockets of air and other non-condensibles are formed in the tubes and the outlet header. This presents a serious problem when the temperature of the cooling air is below freezing, because these pockets are void of hot vapors and thus leave bare metal walls which will quickly cool down to ambient temperature, so that the condensate flowing through the tubes may freeze up and thus cause the tubes to burst.

Many proposals have been made for lessening this freezing problem. For example, U.S. Pat. No. 3,223,152 shows a tube bundle having the tubes in the different rows of a special design intended to effect equal steam condensation in the rows of tubes. However, this design is practical only under given temperature conditions. It has also been the practice to provide the condenser with a main portion of such design that the tubes of all its rows receive only the amount of steam which those of the first row are capable of condensing and to draw off excess steam from succeeding rows to a so-called vent portion connected in series with the main condenser portion. However, since the vent portion is of basically the same construction as the main portion, although on a smaller scale, this at most isolates the abovedescribed freezing problems to only a portion of the tube bundle area. Furthermore, separate main and vent portions add to the overall expense of the condenser since they require additional headers and piping between them, and involve complex controls when there are separate sources of cooling air flow for each portion which must be maintained in proper balance.

U.S. Pat. No. 3,074,479 shows a condenser in which the outlet header of each bundle is formed of separate sections each connecting with one of the tube rows, and means are provided for draining condensate from each section while isolating the pressure therein from that within the others. In the first place, this outlet header construction is complicated and expensive. Furthermore, when air and other non-condensibles are collected into a single line or manifold prior to venting to suitable air removal equipment, as shown in this patent, uncondensed steam included with the non-condensibles may backflow into the tubes of the first rows to be contacted by air. Although U.S. patent application, Ser. No. 747,808, filed Dec. 6, 1976, entitled "Vapor Condensing Apparatus" and assigned to the assignee of the present application, discloses apparatus intended to prevent this problem from occurring, such apparatus is nevertheless also of complicated and expensive construction.

The primary object of this invention is to provide apparatus which overcomes or at least lessens these freezing problems, and, more particularly, which is nevertheless of relatively simple and inexpensive construction.

Another object is to provide such apparatus which is independent of temperature conditions, which does not have separate main and vent portions and the problems attendant thereto, and which does not require special equipment for draining condensate and/or removing air and other noncondensibles from the tubes thereof.

These and other objects are accomplished, in accordance with the illustrated embodiment of the invention, by apparatus in which each tube bundle of a series of such bundles arranged in side-by-side relation to make up an overall condenser has only a single row of tubes, so that there will not be a pressure differential between different tubes at the outlet header, and thus no problem of backflow from one tube to the other. Furthermore, the single row condenser is easier and less expensive to build than the condensers previously described as having been proposed to overcome this problem, not only because of the elimination of the need for fabricating and assembling one or more additional tube rows, but also because both the outlet header and the air removal equipment may be of more or less standard construction.

For this purpose, each tube of the row is of unique construction in that, as compared with conventional round and, in some cases, oval-shaped tubes, it has substantially parallel side walls which are spaced from and generally parallel to the side walls of adjacent tubes. More particularly, these side walls are considerably longer in the direction of air flow than the width of the tube, so as to provide surface areas equivalent to that which would be provided by successive tubes in successive rows.

In the preferred embodiment of the invention, some of the tubes of the bundle are divided into separate, longitudinally extending first and second channels both connecting with the outlet header, with the first channel being arranged to be the first to be contacted by the cooling air. More particularly, the inlet header and the means for draining condensate from the outlet header connect with opposite ends of the first channel, and the means for removing noncondensibles connects only with the second channel at its end near the inlet header, whereby the second channel of certain of such tubes function as vent condenser portions, but without the complex and expensive separate condensers heretofore required for that purpose. Thus, for example, each of the divided tubes is closed at its end near the inlet header and has a partition wall extending from one side wall to the other from its closed end to its opposite end connecting with the outlet header, whereby this additional advantage of the present invention is provided in a very simple and expeditious manner. The likelihood of freezing is further reduced, despite the low heat content of the noncondensibles, because the cooling air passing through the bundle has been warmed by contact with the side walls of the first or condensing passages of these tubes.

In the preferred embodiment of the invention, extended surfaces are provided on the outside of the tubes in the form of pleats having folds secured to the sides of adjacent tubes and extending transverse to the length of the tubes so as to permit air to flow through them. This pleat construction is especially well adapted for fitting between the parallel side walls of adjacent tubes and facilitates securement to each in a simple and inexpensive manner. Preferably, the pleats extend for essentially the full height of the side wall of the tube.

In the drawings, wherein like reference characters are used throughout to designate like parts:

Figure 1:
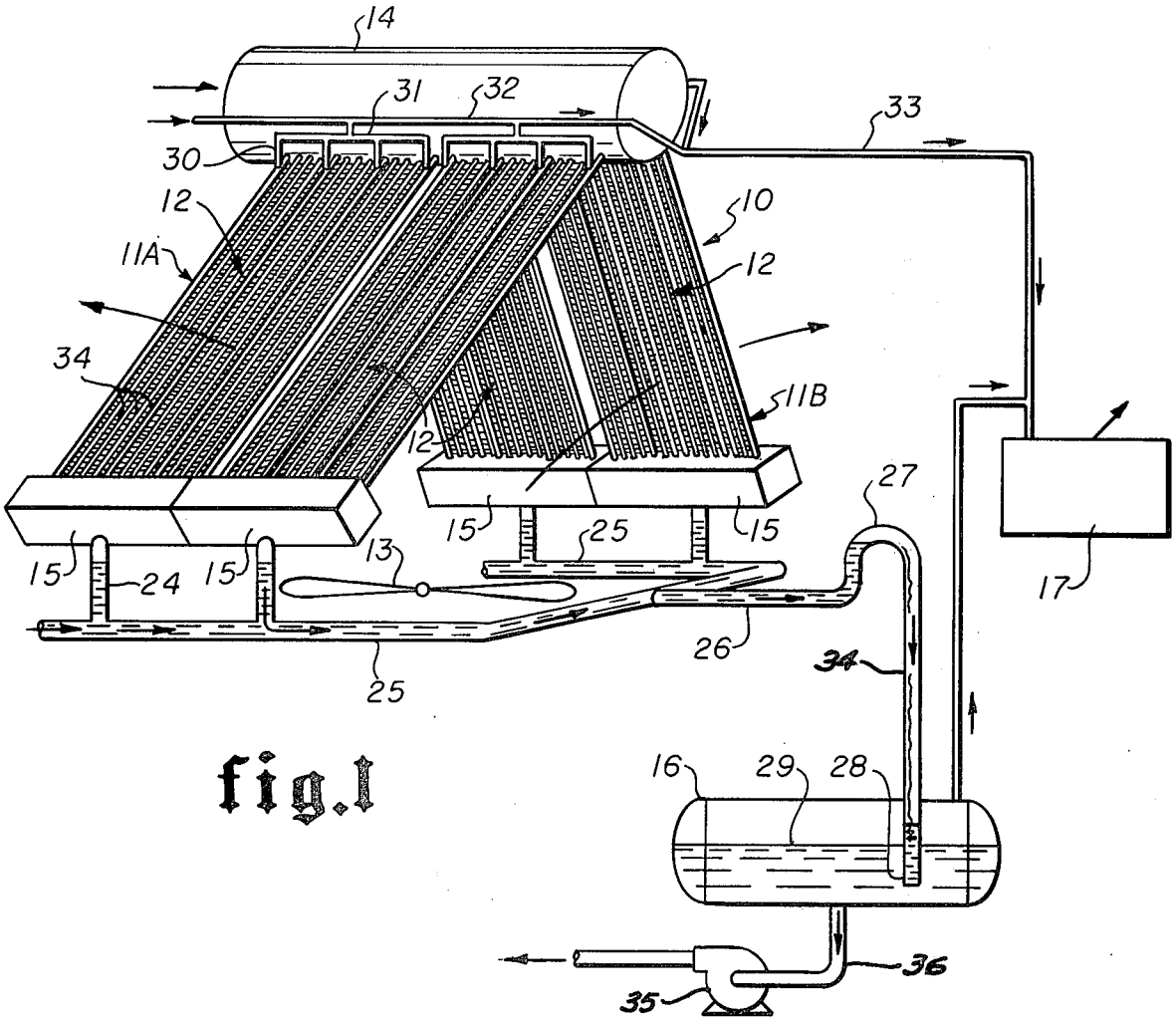
FIG. 1 is a diagrammatic perspective view of a steam condenser having tube bundles constructed in accordance with the present invention.

With reference now to the details of the abovedescribed drawings, the overall condenser, which is indicated by reference character 10, is shown in FIG. 1 to be made up of two banks 11*A*and 11*B*of tube bundles 12 arranged as an "A" frame. As also shown in FIG. 1, the banks of tubes are disposed symmetrically above a fan 13 which induces air flow upwardly and outwardly through the bundles of each bank, as indicated by the arrows of FIG. 1.

The vapor to be condensed, which in this case is steam, which may be from a turbine exhaust (not shown) is introduced into a manifold 14 which extends for the length of the banks of tube bundles and connects with the upper ends of the tubes of the bundles for introducing steam therein. The steam condenses as it moves downwardly through the tubes of the bundles, and the condensate is collected in outlet headers 15 at the lower ends of the bundles. The condensate is drained from the headers into a storage tank 16, and the non-condensibles are collected by a suitable manifold near the upper ends of the bundles for delivery to air removal equipment indicated diagrammatically at 17.

As above described, and as shown in the drawings, each tube bundle 12 comprises a single row of parallel, side-by-side and spaced-apart tubes over which the air passes in a direction generally transverse to the row. Thus, the upper ends of the tubes extend into and connect with the manifold 14, as shown in FIGS. 3 and 4, so that the manifold serves as an inlet header to the bundles of each bank, and the lower ends of the tubes connect with the header 15 which is common to all of them and which, as shown, is preferably of rectangular cross section.

Figure 5:
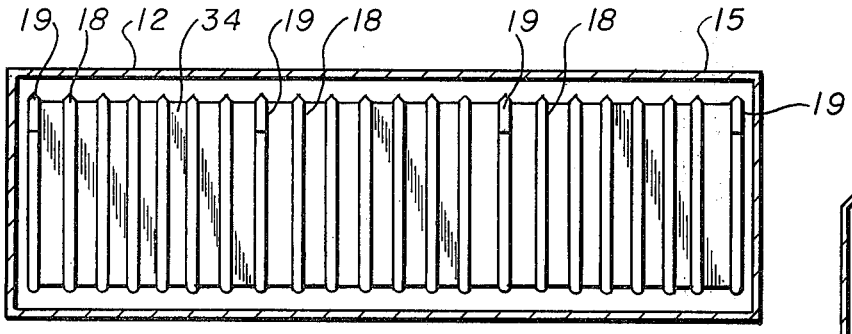
FIG. 5 is a cross-sectional view of the bundle of FIG. 2, as seen along broken lines 5—5 of FIG. 3.
Figure 6:
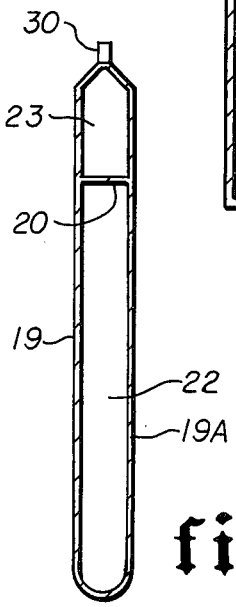
FIG. 6 is an enlarged cross-sectional view of one of the divided tubes.
Figure 7:
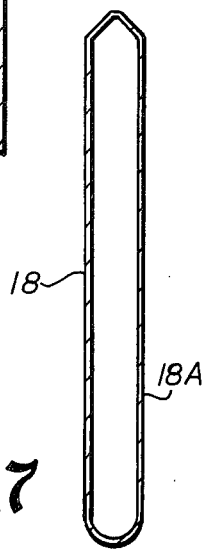
FIG. 7 is an enlarged cross-sectional view of one of the non-divided tubes.
Figure 2:
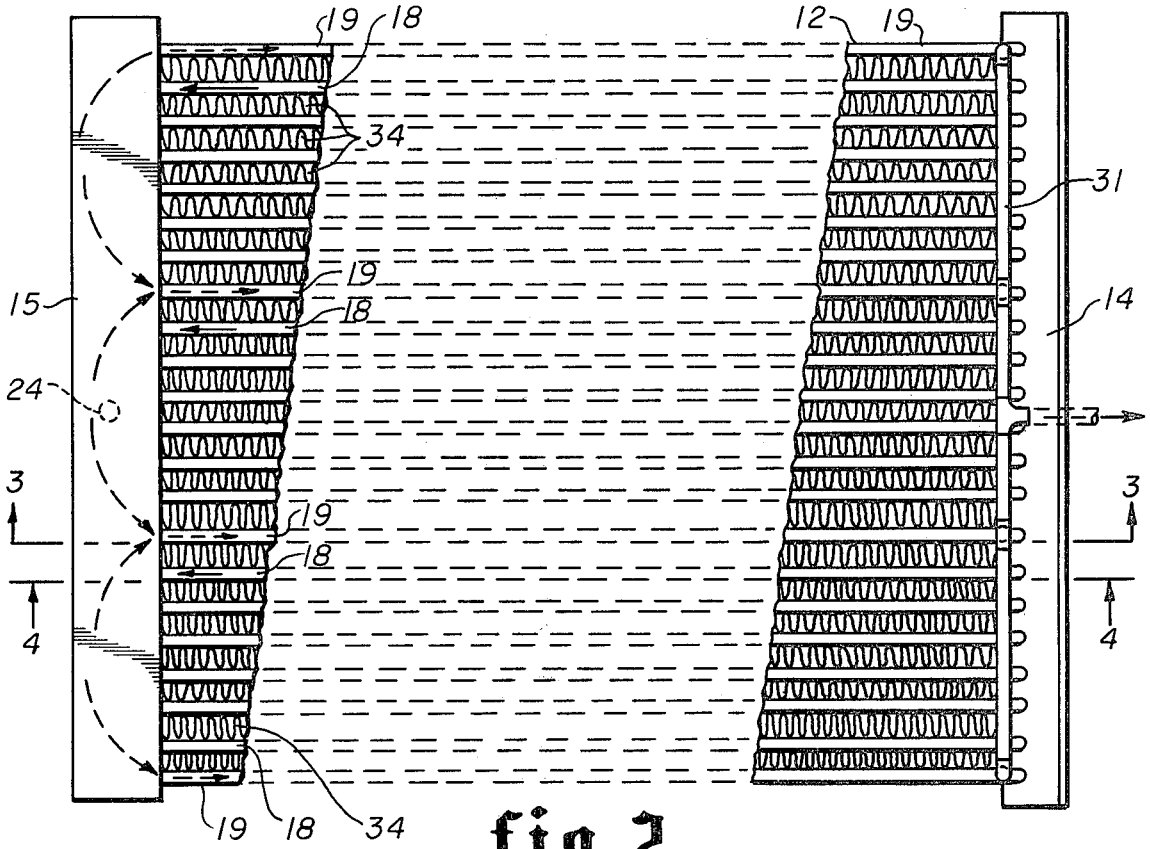
FIG. 2 is a top plan view of one of the bundles on an enlarged scale.
Figure 3:
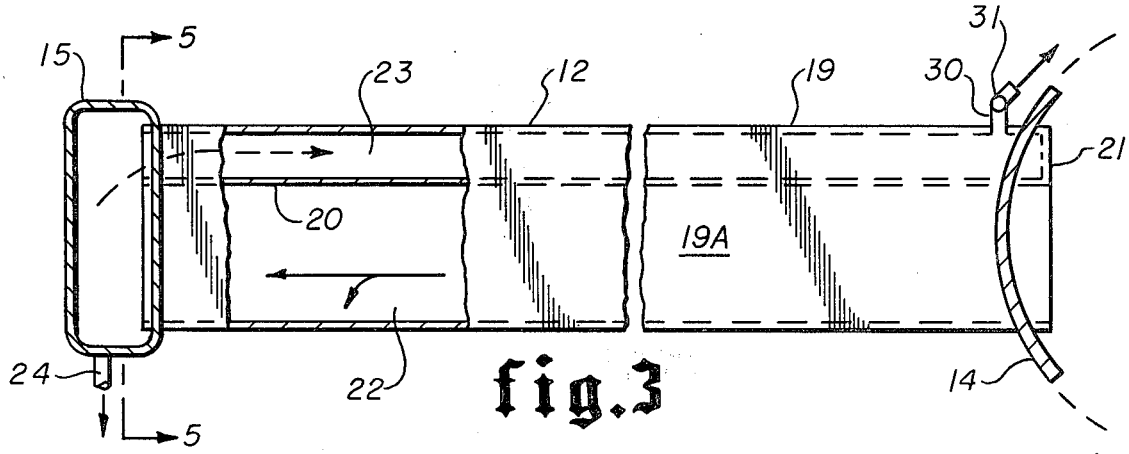
FIG. 3 is a longitudinal sectional view of the tube bundle of FIG. 2, as seen along broken lines 3—3 of FIG.2, showing one of the divided tubes with a portion of its side wall broken away for purposes of illustration.
Figure 4:
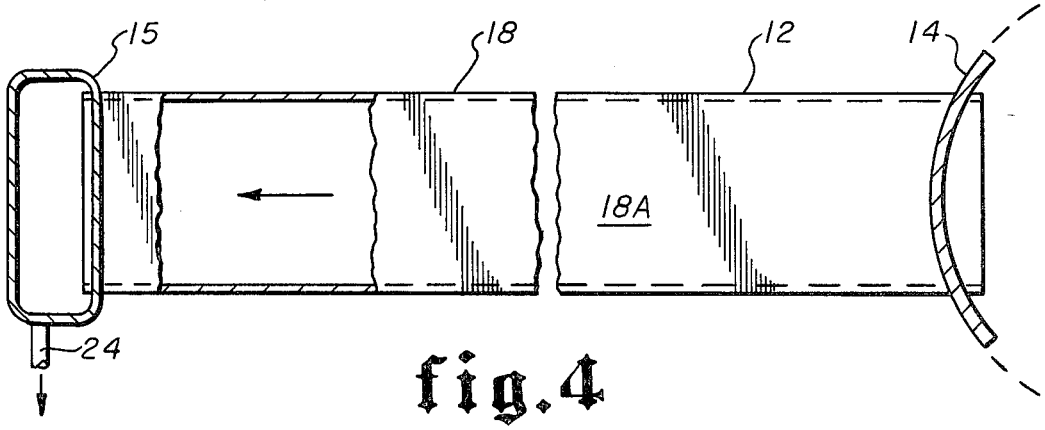
FIG. 4 is a longitudinal sectional view of the tube bundle of FIG. 2, as seen along broken lines 4—4 of FIG. 2, showing one of the non-divided tubes with a portion of its side wall broken away for purposes of illustration.

The tubes of each bundle are of two types, one of which is indicated by reference character 18 and best shown in FIGS. 4 and 7 to be non-divided throughout its length intermediate the inlet and outlet headers, and the other being indicated by reference character 19, and best shown in FIGS. 3 and 6 to be longitudinally divided throughout its length by means of a laterally extending wall 20. As best shown in FIGS. 6 and 7, each of the tubes 18 and 19 has side walls 18*A*and 19*A*, respectively, which are considerably longer in the direction of air flow than the width of the tube, and which, as best shown in FIGS. 2 and 5, are generally parallel to the side walls of adjacent tubes. The tops and bottoms of the tubes are contoured to streamlined shape and thus interfere to a minimum with air flow therepast.

As shown in FIG. 4, the opposite ends of the tubes 18 are open so as to provide free and unimpeded passage for steam to enter the inlet end thereof and condensate to drain from the outlet end thereof into the header 15. Each tube 19, on the other hand, has an end wall 21 extending between the dividing wall 20 and the upper end of the tube. Consequently, the tube 19 comprises a first passage 22 intermediate the dividing wall 20 and the bottom of such tube so as to be first contacted by air flow between the tubes. This first passage is also open at each end so that steam has free and unimpeded passage into it, and condensate is free to drain from its opposite end into the outlet header 15, as in the case of the non-divided tube 18.

However, as indicated by the arrows in FIG. 3, the air and other non-condensibles that are released by the condensing steam are pushed into the outlet header and then purged therefrom into a second passage 23. The latter passage is defined between the dividing wall 20 and the top of each tube 19, and this is the second to be contacted by air flowing upwardly between the tubes. As previously noted, since the ambient air in contact with the second or venting channel of each tube has been previously heated by the lower or condensing portion thereof, it protects the non-condensibles, which have a low steam heat content, from freezing.

The height of the tubes from top to bottom is dependent upon the quantity of steam to be condensed per foot of tube length, and the spacing between adjacent tubes is variable to permit the desired cooling effect with a minimum of power requirement. In any case, the long side walls provide an equivalent of the large surface of a plurality of rows of vertically stacked tubes.

As illustrated diagrammatically in each of FIGS. 2 and 5, and as previously described, it is contemplated that only some of the tubes of each bundle will be of the divided type 19, the exact number depending on the concentration of non-condensibles in the steam. In any event, each such divided tube has its second venting passage 22 opening not only to the outlet ends of the first passages thereof, but also to the header 15 common to the outlet ends of the non-divided tubes 18. Ordinarily, a relatively small number of divided tubes 19 would be spaced over the width of each tube bundle.

As best shown in FIG. 1, the manifolding for removing condensate from the outlet headers 15 to storage tank 16 includes an outlet pipe 24 connecting with each outlet header 15 with a header 25 extending beneath each bank of bundles. Headers 25 are then connected with one another and a common pipe 26 which includes a trap or water loop seal 27 whose lower end 28 extends beneath the liquid level 29 within the tank 16. As shown, this maintains a liquid level in outlet pipes 24 above headers 25, even though a fan servicing one or more bundles of each bank should break down, thereby preventing steam from such bundles from flowing through the manifolding back up into the tubes of bundles which are being serviced by operational fans.

Non-condensibles are removed from the ends of venting passages 23 near the inlet header through manifolding which, as previously mentioned, connects with suitable air removal equipment 17. Thus, as shown in each of FIGS. 3 and 6, a vent pipe 30 extends from the upper end of each vent passage 23 near the wall 21 and outside of the inlet manifold 14 to connect with a manifold pipe 31. As shown diagrammatically in FIG. 1, the manifold pipe 31 for each bundle is in turn connected with a header 32 extending across each bank of bundles, and the headers connect with a common pipe 33 leading to air removal equipment 17.

As also shown in FIG. 1, a line 34 connects the upper end of tank 16 with pipe 33 leading to air removal equipment 17 in order to vent non-condensibles released from steam which is condensed in tank 16. Also, a pump 35 is installed in an outlet 36 from the tank for returning the condensate to the boilers or other area for reuse.

The outside of the tubes of each bundle are provided with extended surfaces which, in the preferred and illustrated embodiment of the invention, comprise pleats 34 having their folds secured by a suitable metallurgical process to sides of adjacent tubes of each bundle. More particularly, the folds are so secured as to extend transverse of the length of the tubes so as to permit air to flow between the pleats. As previously indicated, the spacing between adjacent tubes, and thus the depth of the pleats, as well as the spaces between adjacent pleats, determines the available air space, which in turn governs the amount of power required to force air through the bundles. In any event, the pleats 34 provide a convenient means of varying these conditions, and may be cut to suitable widths along the length thereof so as to extend from substantially top to bottom of each tube. Relatively shallow pleats are secured to the outer sides of the endmost tubes of each bundle.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Apparatus for use in condensing steam or vapors containing non-condensibles such as air, comprising a tube bundle having only a single row of parallel, side-by-side an spaced-apart tubes, an inlet header for introducing steam into one end of the tubes of the row, an outlet header connecting with the opposite ends of the tubes of the row, means for causing air to pass over the tubes in a direction generally transverse to the row, each tube having substantially parallel side walls which are generally parallel to the side walls of adjacent tubes, said side walls being considerably longer in the direction of air flow than the width of the tube, means for draining condensate and removing non-condensibles from said outlet header when the bundle is disposed in a position with the inlet header higher than the outlet header, some but not all of the tubes of the bundle being divided into a pair of separate, longitudinally extending channels both connecting with the outlet header, said inlet header and said means for draining condensate connecting with said channel which is the first to be contacted by air, and said means for removing non-condensibles connecting only with said second channel at its end near said inlet header.

2. A tube bundle of the character defined in claim 1, including extended surfaces on the outside of the tubes comprising pleats having their folds secured to sides of adjacent tubes and extending transverse to the length of the tubes so as to permit air to flow between them.

3. A tube bundle of the character defined in claim 1, wherein the second channel of each of said divided tubes is closed at its end near the inlet header and has a partition wall extending from one side wall to the other from its closed end to its opposite end connecting with the outlet header.

4. A tube bundle of the character defined in claim 3, each said channel being of relatively constant cross-sectional area from one end to the other, with the cross-sectional area of the channel first to be contacted by air being substantially larger than that of the other channel.

* * * * *